United States Patent [19]

Kaczmarek

[11] 4,184,244

[45] Jan. 22, 1980

[54] CONDUCTOR TERMINATING APPARATUS

[75] Inventor: Leonard J. Kaczmarek, Wonder Lake, Ill.

[73] Assignee: Bunker Ramo Corporation, Oak Brook, Ill.

[21] Appl. No.: 900,229

[22] Filed: Apr. 26, 1978

[51] Int. Cl.[2] ..... H01R 43/04

[52] U.S. Cl. ..... 29/566.3; 29/749; 29/751

[58] Field of Search ..... 29/749, 751, 753, 566.3, 29/566.4

[56] References Cited

U.S. PATENT DOCUMENTS

| | | | |
|---|---|---|---|
| 3,708,852 | 1/1973 | Mason | 29/751 |
| 3,798,734 | 3/1974 | Fedor | 29/741 |
| 3,810,289 | 5/1974 | Hannabery | 81/9.51 |
| 3,911,717 | 10/1975 | Yuda | 72/331 |
| 3,940,838 | 3/1976 | Cryctko | 29/751 |
| 3,952,392 | 4/1976 | Nijman et al. | 29/566.3 |
| 3,956,811 | 5/1976 | Munshower | 29/753 |
| 3,999,270 | 12/1976 | Witte | 29/749 |
| 4,047,294 | 9/1977 | Quigley | 29/749 |
| 4,048,711 | 9/1977 | Haller | 29/566.3 |
| 4,095,336 | 6/1978 | Throne | 29/749 |

FOREIGN PATENT DOCUMENTS 2157492 6/1973 France .

*Primary Examiner*—Carl E. Hall

*Attorney, Agent, or Firm*—F. M. Arbuckle; J. R. Hoffman; W. Lohff

[57] ABSTRACT

An apparatus for simultaneously terminating a plurality of insulated conductors in the insulation piercing contacts of a multiple contact electrical connector is disclosed. The apparatus includes means for mounting a connector in conductor receiving position, means for aligning the conductors adjacent individual contacts of the connector, means for positioning an insertion member adjacent the contacts, and resilient means forcibly engaged by the insertion member during the termination process. The apparatus allows sufficient displacement of the resilient means by the insertion member so as to accommodate various transverse dimensions of electrical connectors without the necessity of any adjustment.

6 Claims, 8 Drawing Figures

CONDUCTOR TERMINATING APPARATUS

BACKGROUND OF THE INVENTION

The present invention relates to an apparatus for simultaneously terminating a plurality of insulated conductors in the insulation piercing contacts of a multiple contact electrical connector and, more particularly, to a device which can accommodate electrical connectors having various transverse dimensions without the necessity of any adjustment.

With the development of miniaturized electrical and electronic components, suitable connectors having multiple insulation piercing contacts have been developed for use in the electrical, communication, and data handling industries. These advances have spawned development of a number of tools and devices directed to the resulting problem of terminating a plurality of conductors in the multiple contacts of a connector. Some examples of such recent art are: Cable Terminating Machine, U.S. Pat. No. 3,810,289; Wire Insertion Apparatus, U.S. Pat. No. 3,999,270; Apparatus For Terminating Flat Conductor Cable, U.S. Pat. No. 3,956,811; and Field Termination Tool Having Connector Reference Plane Apparatus And Hinged Insertion Arms, U.S. Pat. No. 3,952,392. The last mentioned patent discloses a termination tool designed to force a plurality of insulated conductors into the insulation piercing contacts of multiple contact electrical connectors having different transverse dimensions. It accomplishes this by providing an apparatus having a pair of oppositely disposed rotatable insertion arms which may be operably controlled by manual adjustment means. Accordingly, it is necessary for the operator to manually adjust the tool whenever connectors of different transverse dimensions are to be utilized with this construction.

Another type of termination tool useful for accommodating different transverse dimensions between connectors is disclosed in commonly owned, copending application, Conductor Terminating Apparatus, Ser. No. 735,955, filed Oct. 27, 1976, now abandoned, which utilizes a ratchet. The ratchet has at least two release recesses with one recess signalling movement to the proper position for terminating the compression stroke of a stuffer for a female connector and another recess signalling movement to the proper position for terminating the stroke for a male connector. While this device does accommodate different transverse dimensions between connectors, it nevertheless must be selectively manually operated for each connector.

While prior art termination tools have met with varying degrees of success, there are disadvantages associated with the manufacture and use of most of them which have limited their acceptance. For example, since the insertion tool, itself, usually moves through an arc in effecting the termination of the conductors, it has generally not been possible to achieve precise uniformity of termination force across an entire row of contacts in the connector. Moreover, in a given line of connectors, the dimension between oppositely facing rows of contacts will be less in the female connector than in the corresponding male connector. Thus, the desired parallel relationship of the insertion tools as the rotatable arms reach the terminating position is difficult at best to achieve for both female and male connectors. To overcome this disadvantage, it has been suggested to provide an apparatus wherein the pivot of one of the rotatable arms is movable to accommodate connectors having different transverse dimensions, but this procedure is time consuming and may not be entirely accurate in any event.

A further disadvantage associated with prior art devices is that there has been no truly automatic means for accommodating connectors having different transverse dimensions. This objective has been closely approached in the copending application referenced above although the termination tool there disclosed still requires selective manual operation. While this represents an important advance in the art, the possibility of error on the part of the operator is present since successful operation depends upon the operator to a significant degree meaning that faulty terminations or damaged connectors could result.

SUMMARY OF THE INVENTION

With the present invention, a new and improved termination apparatus particularly useful as a field termination apparatus is disclosed for simultaneously terminating a plurality of insulated conductors in the insulation piercing contacts of a multiple contact electrical connector. The apparatus provides precise and uniform termination forces for each of the contacts of either a male or female multiple contact connector regardless of dimensional variations across the width of the connectors while insuring that the insertion tool travels the appropriate distance to effect proper conductor termination in both male and female connectors along a path substantially perpendicular to the planes defined by the rows of contacts in the connector. Depending upon the width of the connector being utilized at a given time, an insertion member will stop when the conductors are properly terminated and any remaining travel of the force supplying member will be taken up by resilient means interposed to cooperate with the insertion member.

The present invention therefore overcomes the need for manual adjustment or selective manual operation while at the same time providing an apparatus capable of simultaneously terminating a plurality of insulated conductors in the insulation piercing contacts of a multiple contact electrical connector. The apparatus advantageously utilizes means for mounting a connector in conductor receiving position, means for aligning the conductors adjacent individual contacts of the connector, means for positioning an insertion member adjacent the contacts, and resilient means forcibly engaged by the insertion member during the termination process. The apparatus allows sufficient displacement of the resilient means by the insertion member so as to automatically accommodate electrical connectors having a range of transverse dimensions.

It is therefore an object of the present invention to provide a new and improved apparatus for simultaneously terminating a plurality of insulated conductors.

Another object is to provide an apparatus for terminating a plurality of insulated conductors in the insulation piercing contacts of multiple contact electrical connectors whose transverse dimensions may vary over a substantial range.

An additional object is to provide an apparatus for terminating a plurality of insulated conductors in insulation piercing contacts of multiple contact electrical connectors of varying transverse dimensions automatically without requiring any mechanical adjustment or any selective manual operation.

BRIEF DESCRIPTION OF THE DRAWINGS

The features of the present invention which are believed to be novel are set forth with particularlity in the appended claims. The invention, together with the further objects and advantages thereof, may best be understood by reference to the following description taken in conjunction with the accompanying drawings. In the drawings, like reference numerals identify like elements in the several figures, in which:

DETAILED DESCRIPTION OF THE PREFERRED EMBODIMENT

Figure 1:
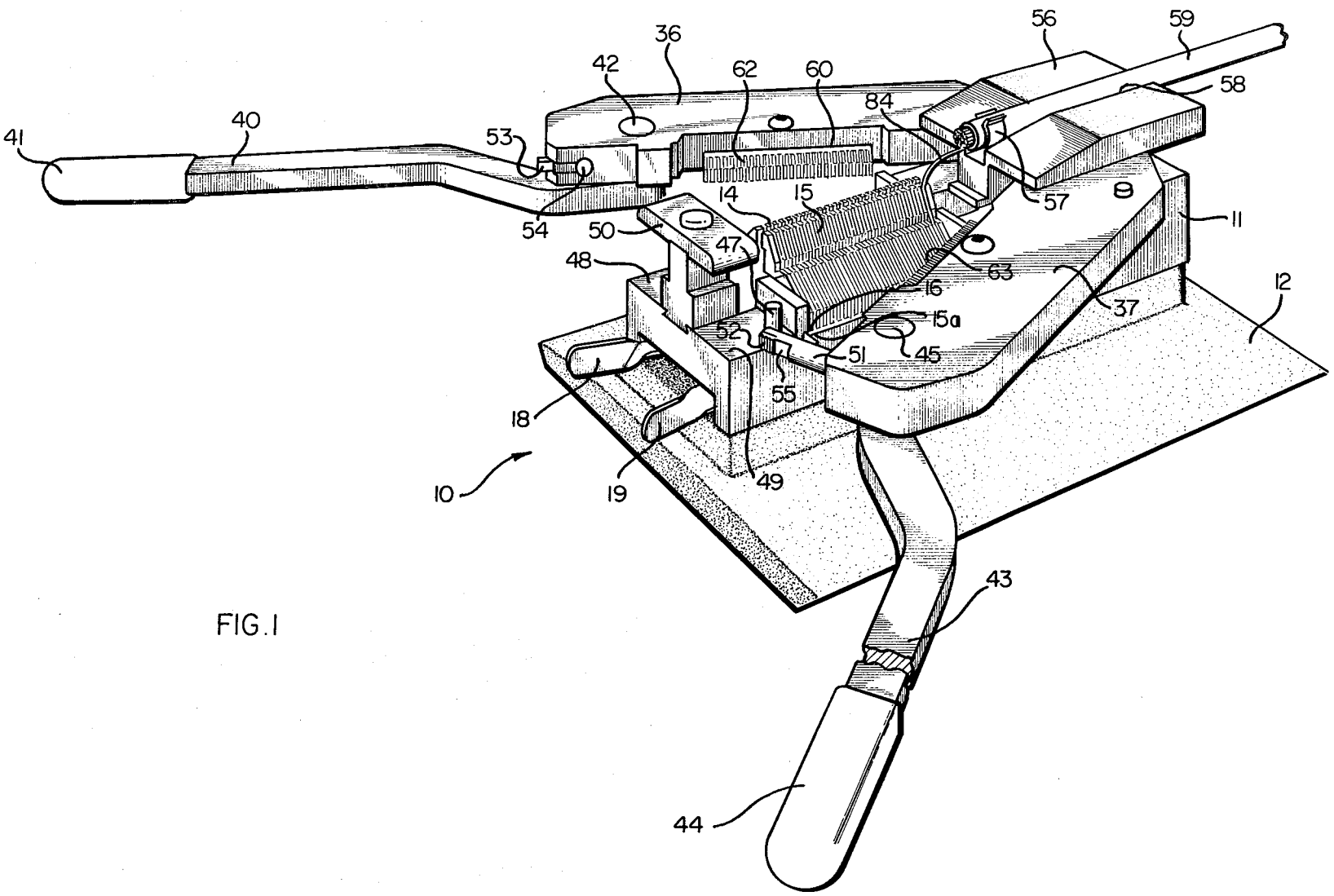
FIG. 1 is a perspective view of a conductor terminating apparatus constructed in accordance with the present invention.
Figure 2:
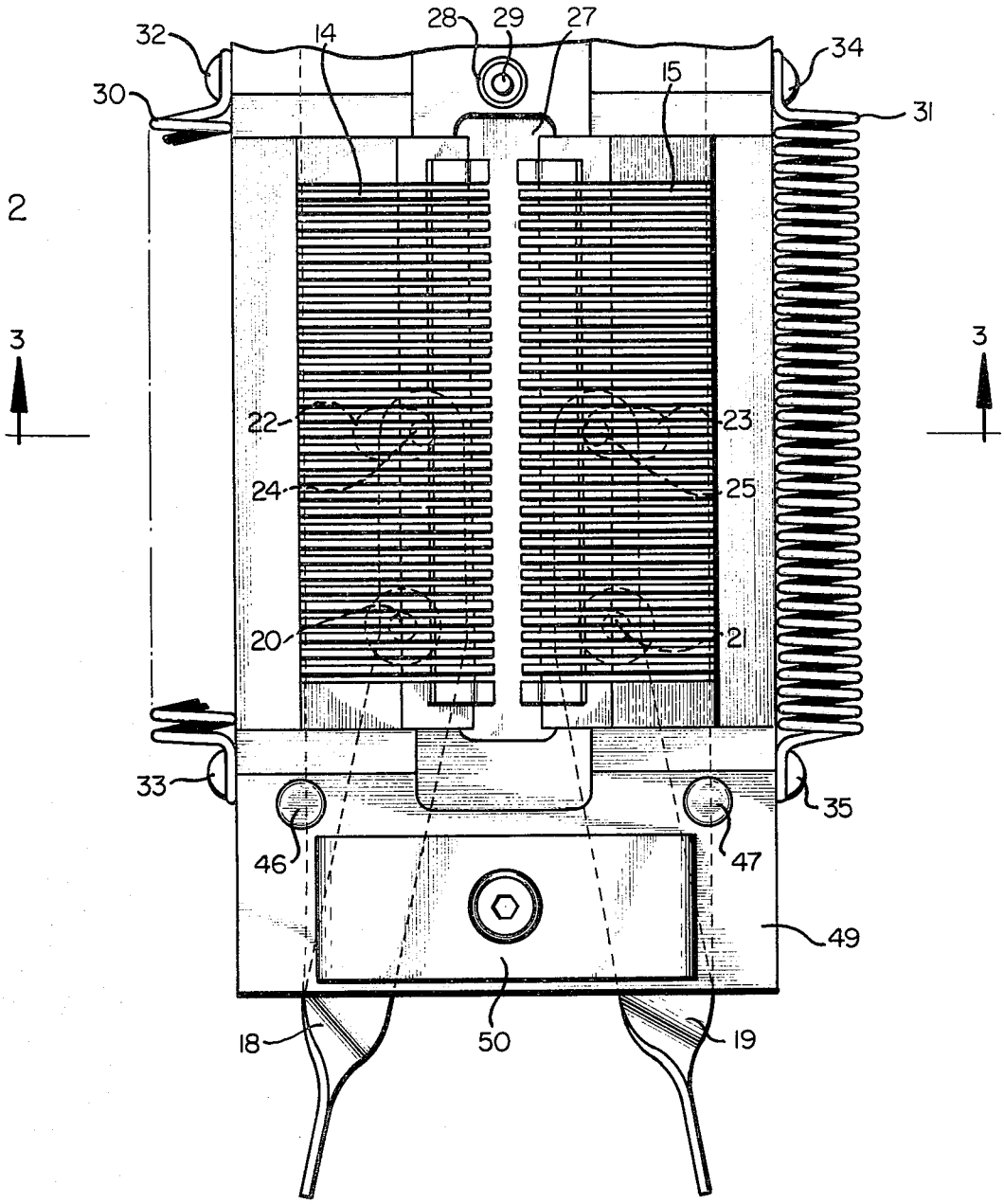
FIG. 2 is a plan view of a portion of the conductor terminating apparatus illustrated in FIG. 1 with the connector positioning and holding mechanism in a connector gripping position.
Figure 3:
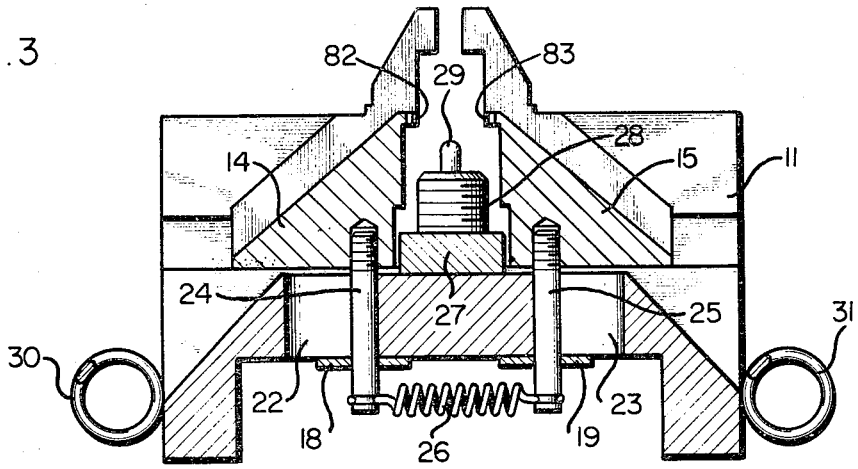
FIG. 3 is a cross-sectional view of the conductor terminating apparatus taken along the lines 3—3 of FIG. 2.

In the illustration given and with reference first to FIGS. 1, 2 and 3, a preferred embodiment of the conductor terminating apparatus, designated generally as 10, is shown in which a frame 11 is rigidly mounted on a base 12 by bolts or other suitable fasteners (not shown). The apparatus 10 also includes combs 14 and 15 each composed of a multiplicity of vertical blades which are mounted for sliding movement in a plane parallel to the base 12. The combs 14 and 15 each have rail portions such as 15*a* at opposite ends thereof which slide in slots such as slot 16 in frame 11. The apparatus 10 further includes arms 18 and 19 which are pivotally mounted to the frame 11 by pins 20 and 21 for operating the combs 14 and 15 for sliding movement.

Referring to FIG. 2, the frame 11 has slots 22 and 23 provided therein to receive pins 24 and 25, respectively, which extend through the arms 18 and 19 adjacent corresponding ends thereof and are rigidly mounted to the combs 14 and 15. The pin 24 extends upward through the slot 22 and is threaded or otherwise fastened to the comb 14 and the pin 25 extends upwardly through the slot 23 and is threaded or otherwise fastened to the comb 15 (as may be more clearly seen and appreciated from FIG. 3). A spring 26 is secured to the lower end of the pins 24 and 25 thereby joining them so as to urge the pins 24 and 25 and therefore the combs 14 and 15 inwardly towards each other.

Referring more particularly to FIGS. 2 and 3, a connector support plate 27 is rigidly mounted on the frame 11. A positioning pin 28 is located adjacent one end of the support plate 27 and is also rigidly mounted to the frame 11. The positioning pin 28 has a nipple 29 on its upper end for insertion into an aperture in the end flange of a connector to thereby correctly position it on the plate 27. Additionally, springs 30 and 31 are connected at their ends to the frame 11 by screws 32–35 with the springs 30 and 31 running generally parallel to the connector support plate 27 for a purpose to be described in greater detail hereinafter.

Figure 6:
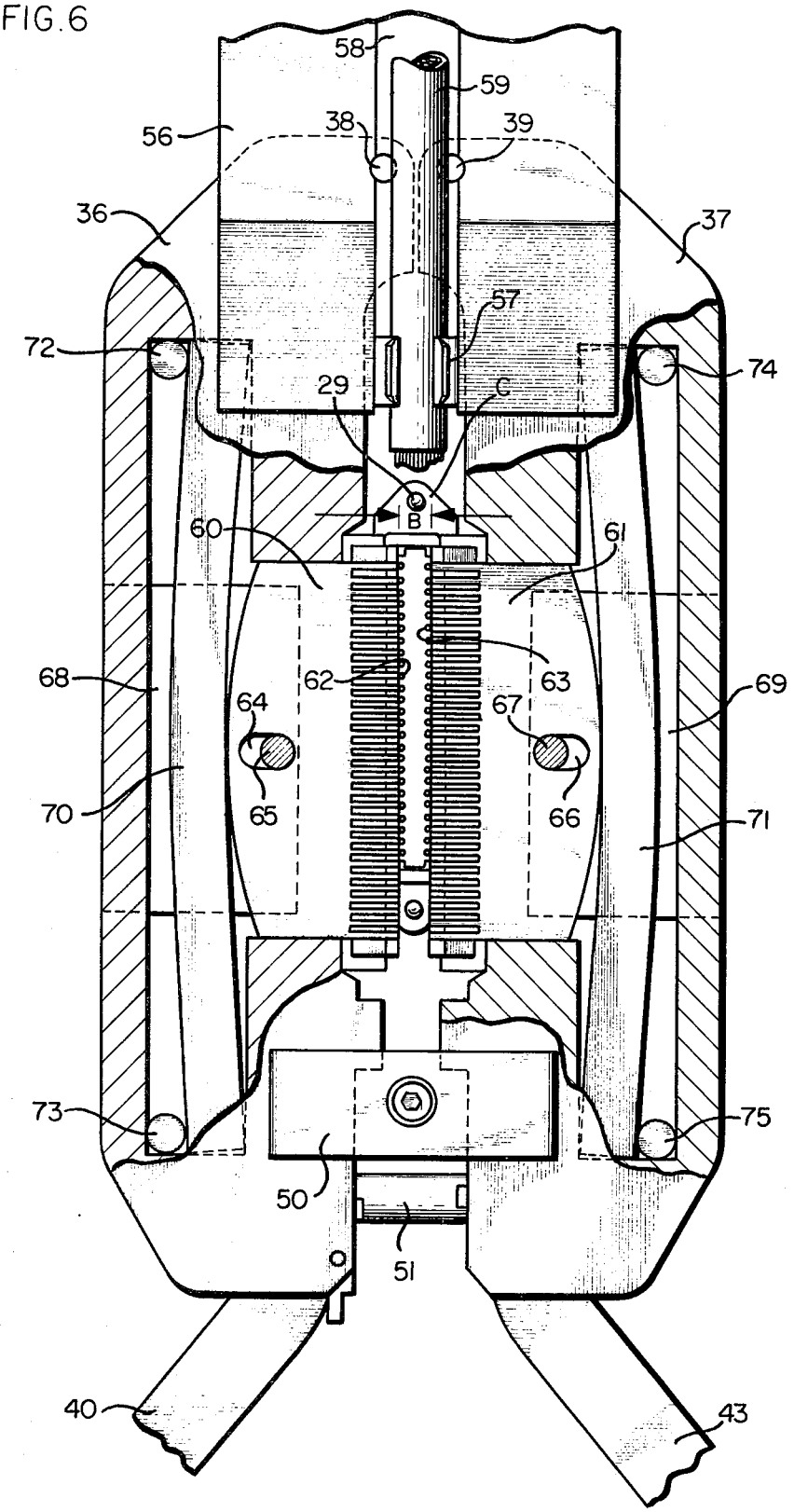
FIG. 6 is a plan view of a portion of the conductor terminating apparatus illustrated in FIG. 1 with the force applying arms closed and pressure being applied to a wide connector.

The apparatus 10 also includes force applying arms 36 and 37 (as shown in FIGS. 1 and 6) which are rotatably mounted on pins 38 and 39 rigidly mounted on the frame 11. An arm 40 having a handle 41 is rotatably mounted to the force applying arm 36 by a pin 42 and, in like manner, an arm 43 having a handle 44 is rotatably mounted to the force applying arm 37 by a pin 45. Acting as pivot points or fulcrums, a pair of pins 46 and 47 are rigidly mounted on the frame 11 to cooperate with the ends of the arms 40 and 43 nearest the pins 42 and 45 when the force applying arms 36 and 37 are moved inwardly toward the frame 11. As the force applying arms 36 and 37 are moved inwardly, the arms 40 and 43 are guided toward a closed position by a pair of surfaces 48 and 49 of the frame 11 and a T-shaped guide 50 mounted on the end of the frame 11 guides the force applying arms 36 and 37 toward a closed position as well. A pin 51 having ratchet teeth 52 is rigidly mounted to the force applying arm 37 and a ratchet pawl 53 is mounted in the force applying arm 36 with its end extending into an aperture 54. When the force applying arms 36 and 37 are brought together (as shown in FIG. 6), the pin 51 enters the aperture 54 and the ratchet teeth 52 engage the ratchet pawl 53 with a flat surface 55 being positioned on the pin 51 to release the ratchet as will be more fully described hereinafter.

The pivoted ends of the force applying arms 36 and 37 are guided during rotation thereof by a guide member 56 which is rigidly mounted on the frame 11. A spring clip 57 (as shown in FIG. 1) is mounted on the guide member 56 at the end of an arcuate groove 58. With this latter feature, a cable 59 of conductors can be held in position within the arcuate groove 58 by the spring clip 57.

Figure 8:
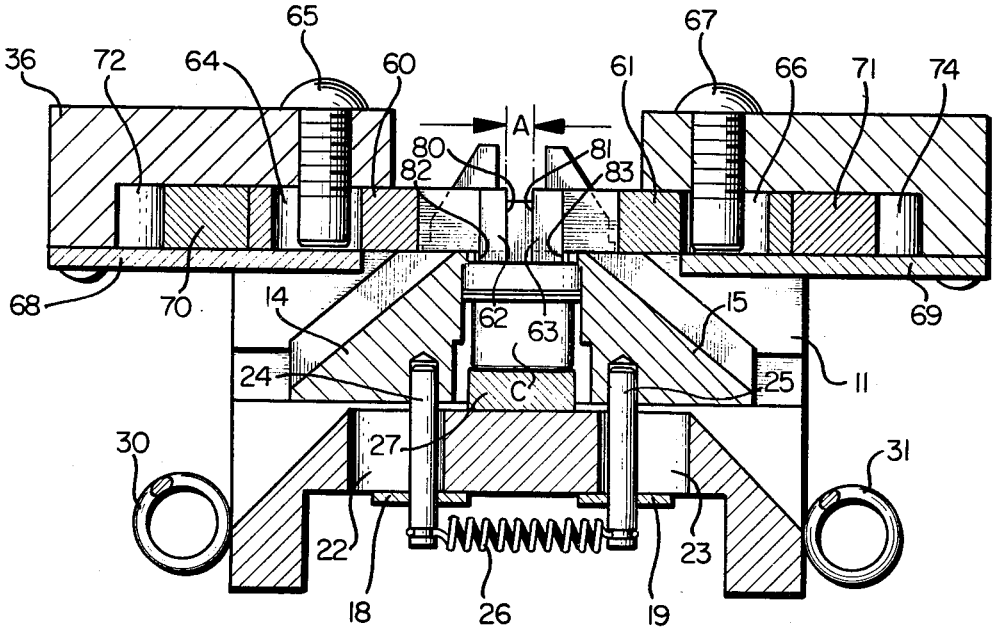
FIG. 8 is a cross-sectional view taken along the lines 8—8 of FIG. 7.

Referring now to FIG. 6, insertion members 60 and 61 are slidably mounted in the force applying arms 36 and 37. The insertion member 60 has a series of insertion blades generally indicated at 62, and the insertion member 61 has a series of insertion blades generally indicated at 63. A slot 64 is provided in the insertion member 60 for receiving a screw or other fastening means 65, and the insertion member 61 has a slot 66 for receiving a screw or other fastening means 67. The insertion members 60 and 61 slide on removable lower plates 68 and 69 of the respective force applying arms 36 and 37 (as shown in FIGS. 6 and 8) and are limited in their travel by the length of their respective slots 64 and 66. A pair of leaf springs 70 and 71 rest on the plates 68 and 69, respectively, along a portion of their lengths with the ends of the spring 70 being engaged by a pair of pins 72 and 73 rigidly mounted on the force applying arm 36. The ends of the leaf spring 71 are engaged by a pair of pins 74 and 75 rigidly mounted on the force applying arm 37 in like manner. With this construction, the center of the leaf spring 70 engages the center arcuate portion of the insertion member 60 and the center of the leaf spring 71 engages the center arcuate portion of the insertion member 61 normally urging the respective insertion members inwardly.

As will be appreciated by those skilled in the art, each of the series of insertion blades 62 and 63 have a cutting edge generally indicated at 80 and 81. Corresponding cutting edges generally indicated at 82 and 83 are then provided on the combs 14 and 15. Of course, the cutting edges 82 and 83 on the combs 14 and 15 are positioned to cooperate with the cutting edges 80 and 81 on the insertion blades 62 and 63 in a well known manner.

Figure 4:
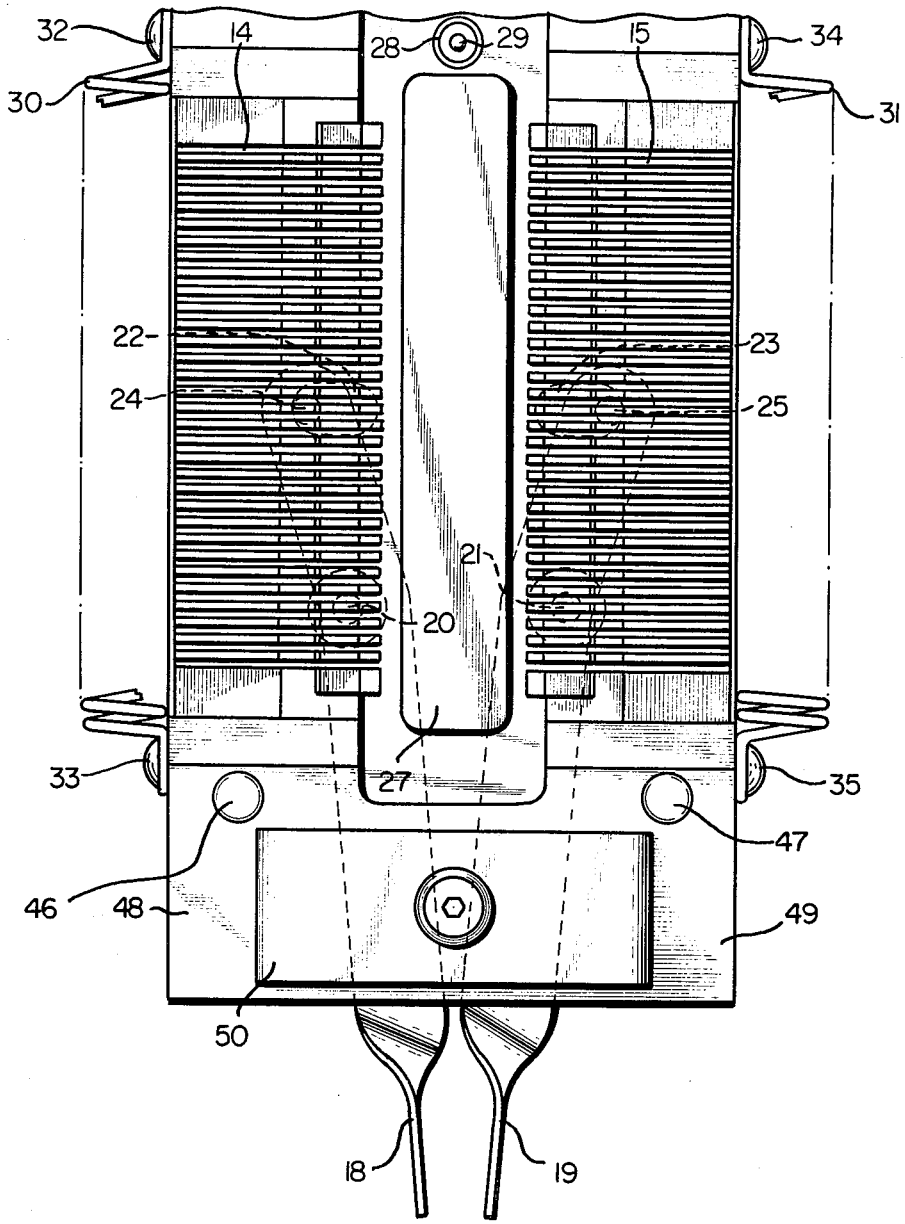
FIG. 4 is a plan view of the portion of the conductor terminating apparatus illustrated in FIG. 2 with the connector positioning and holding mechanism in a connector receiving position.
Figure 5:
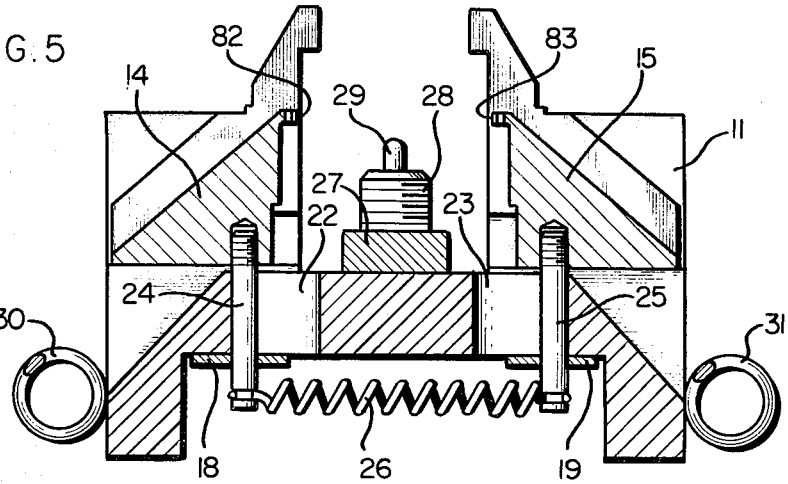
FIG. 5 is a cross-sectional view of the conductor terminating apparatus taken along the lines 5—5 of FIG. 4.
Figure 7:
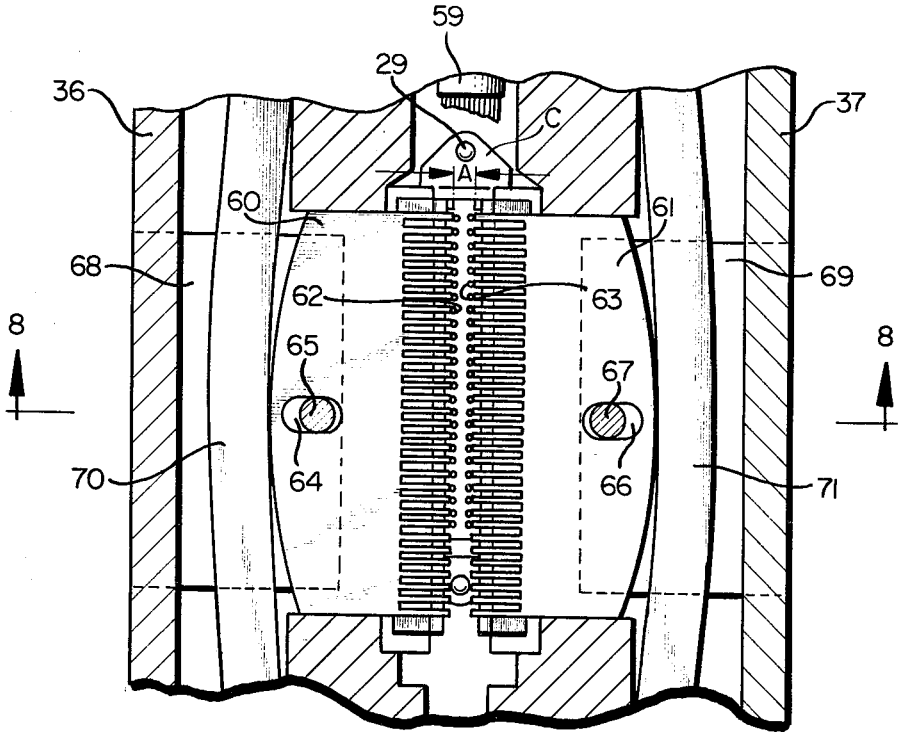
FIG. 7 is a plan view of a portion of the conductor terminating apparatus illustrated in FIG. 1 with the force applying arms closed and pressure being applied to a narrow connector.

Referring first to FIGS. 1 through 5, the operation of the apparatus 10 will now be described in greater detail. The ends of the comb arms 18 and 19 remote from the pins 24 and 25 are normally spread apart, by reason of the biasing effect of the spring 26 on the pins 24 and 26 (as shown in FIGS. 1 through 3). Since the pins 24 and 25 are threaded into the combs 14 and 15, the combs 14 and 15 are forced by the spring 26 into their closed position. To insert a connector, the arms 18 and 19 are pressed together by an operator to cause the combs 14 and 15 to be spread apart (as shown in FIGS. 4 and 5). As the arms 18 and 19 are pressed together, the pins 24 and 25 move outwardly across their respective slots 22 and 23 until they engage the outer ends of these slots at which point a connector C can be placed on the support 27 with the aperture in the end flange over the tip 29 (as shown in FIGS. 6 through 8). The operator then releases the arms 18 and 19 which allows the combs 14 and 15 to close over the connector C and, in conjunction with the support 27 and the pin 28, position it and hold it in a proper position for awaiting further operation of the apparatus 10 to properly terminate insulated conductors in the connector C.

Referring now to FIGS. 1 and 6 through 8, a cable 59 containing a multiplicity of insulated conductors is placed in the arcuate groove 58 with the end thereof clamped in the spring clip 57, and with the plurality of internal insulated conductors extending out over the combs 14 and 15. Each insulated conductor, as depicted, for instance, by the conductor 84, is placed down through two adjacent blades of either the comb 14 or the comb 15 adjacent the contact to which it is to be terminated. To further secure the insulated conductor 84, it is placed through the coils of the spring 31 which may include color code means associated therewith where the insulation of individual conductors is of differing colors to correctly position conductors relative to the connector C. In like manner, each insulated conductor is placed down through two adjacent blades of either the comb 14 or the comb 15 and through the coils of the springs 30 or 31. When all of the conductors are in place between the blades of the combs 14 and 14 in accordance with a predetermined arrangement, the force applying arms 36 and 37 are rotated inwardly until they are over the surfaces 48 and 49, and under the T-shaped guide 50 at which point the ends of the arms 40 and 43 are in position to engage the pins 46 and 47 in typical lever fashion.

As the arms 40 and 43 are brought together, their ends pivot on the pins or fulcrums 46 and 47 causing the force applying arms 36 and 37 to bring the insertion members 60 and 61 toward one another in substantially perpendicular relationship (as shown in FIGS. 6 and 7). The insertion members 60 and 61 are applying pressure to the springs 70 and 71 at this point and the springs 70 and 71 are in turn urging the insertion blades 62 and 63 of the insertion members 60 and 61 inwardly into the combs 14 and 15. The insertion blades 62 and 63 press the insulated conductors further into the combs 14 and 15 as the force applying arms 36 and 37 are moved inwardly. The conductors are cut to length by the cooperation of the cutting edges 80 and 81 on the lower end of the insertion blades 62 and 63 and the corresponding cutting edges 82 and 83 on the combs 14 and 15.

As the operator applies still more greater pressure to the handles 41 and 44, they continue to move towards each other thereby further pivoting the other ends of the arms 40 and 43 on the pins or fulcrums 46 and 47 as the pin 51 penetrates into the aperture 54. The further inward movement needed to force the conductors into the insulation piercing contact is accomplished by moving the handles 41 and 44 together with the insertion members 60 and 61 bearing on the springs 70 and 71. With the pawl 53 engaging the ratchet teeth 52, the force applying arms 36 and 37 cannot be opened until the operator has applied enough pressure through the handles 41 and 44 to force the arms together to the point that pawl 53 reaches the blank space 55, unlocking the arms. The operator is thereby precluded from failing to use sufficient terminating pressure regardless of the transverse dimension of the connector being utilized at any given time. In addition, the operator is also precluded from using too much terminating pressure which might damage the connector since the springs 70 and 71 will deflect to a degree depending upon the transverse dimension of the connector to take up any remaining movement of the force applying arms 36 and 37 relative to the insertion members 60 and 61 after the insertion blades 62 and 63 have terminated the conductors in the insulation piercing contacts.

Referring to FIGS. 6 and 7, the narrower the connector (such as width A), the less will be the bend of the springs 70 and 71, and the wider the connector (such as width B), the greater will be the bend of the springs 70 and 71. A given set of springs 70 and 71 will accommodate connectors of different transverse dimensions although the best or deflection can be controlled where desired by varying the spring constant and other design parameters in well known fashion. Thus, not only male or female connectors of a particular design and manufacturing lot can be accommodated without the need for manual adjustment or selective manual operation but a wide variety of various connector widths—both male and female—can be accommodated without the need for manual adjustment or selective manual operation as well.

After the ratchet pawl 53 releases, the operator then opens the force applying arms 36 and 37 and retracts the combs 14 and 15 by pivoting the handles 41 and 44 away from one another and then pivoting the force applying arms 36 and 37 away from one another to allow the conductor terminated connector to be removed from the apparatus.

As to other aspects of the apparatus 10, it will be understood and appreciated that such aspects are unimportant for purposes of understanding the inventive concepts. For instance, the exact means by which the blades 80 and 81 of the insertion members 60 and 61 cooperate with the blades 82 and 83 of the combs 14 and 15 to terminate the conductors in the insulation piercing contacts has not been described since it is conventional. Additionally, it is contemplated that comparable new features may be developed in the future which will work equally well with the apparatus 10 and the inventive concepts embodied therein.

While the present invention is susceptible of embodiment in many different forms, there has been described herein in detail a preferred embodiment with the understanding that the present disclosure is to be considered as an exemplification of the principles of the invention and is not intended to limit the invention to the embodiment illustrated. Accordingly, the details herein given may be varied by those skilled in the art without departing from the spirit and scope of the invention set forth in and defined by the appended claims.

I claim:

1. In an apparatus for simultaneously terminating a plurality of insulated conductors in at least one row of insulation piercing contacts of an electrical connector, said apparatus being of the type having means for locating and holding said electrical connector in a fixed position, means for positioning said insulated conductors adjacent respective ones of said insulation piercing contacts, termination means for terminating said insulated conductors in said insulation piercing contacts when force is applied thereto, and means for appling force to said termination means, the improvement comprising:

resilient means operatively associated with said termination means and said force applying means so that said force applying means and said termination means automatically apply precise and uniform termination forces to each of said insulated conductors to assure proper termination of said insulation piercing contacts regardless of the transverse dimension of said connector, said resilient means comprising an elongated, unitary spring bar supported adjacent its ends by said force applying means and effectively applying forces intermediate its ends to said termination means.

2. The termination apparatus as defined in claim 1, wherein said spring bar is supported at its ends at least in part by pins rigidly mounted on said force applying means.

3. The termination apparatus as defined in claim 1, wherein said spring directly engages said termination means intermediate the ends thereof.

4. An apparatus for simultaneously terminating a plurality of insulated conductors in at least one row of insulation piercing contacts of an electrical connector comprising:

means for locating and holding said electrical connector in a fixed position;

means for positioning said insulated conductors adjacent respective ones of said insulation piercing contacts;

insertion means including a plurality of insertion blades for pressing said conductors into respective ones of said insulation piercing contacts, means for applying force to said insertion means mounted for movement relative to said connector locating and holding means;

said insertion means being mounted for relative sliding movement on said force applying means; and resilient means operatively associated with said insertion means and said force applying means so that said insertion blades automatically apply a precise and uniform termination force to each of said insulated conductors to assure proper termination in said insulation piercing contacts regardless of the transverse dimension of said connector, said insertion means remaining stationary relative to said connector upon reaching said termination force, said resilient means comprising an elongated, unitary spring bar supported adjacent its ends by said force applying means and effectively applying forces intermediate its ends to said termination means, said spring deflecting sufficiently to take up any remaining movement of said force applying means relative to said insertion means and said connector locating and holding means.

5. The termination apparatus as defined in claim 4 wherein cutting means is rigidly mounted on said locating and holding means, said cutting means including a plurality of cutting edges.

6. The termination apparatus as defined in claim 5 wherein a cutting edge is formed on each of said insertion blades which cooperates with said cutting edges of said cutting means to sever conductors immediately prior to insertion into the respective ones of said insulation piercing contacts.

* * * * *